United States Patent [19]

Cruson

[11] Patent Number: 4,771,717

[45] Date of Patent: Sep. 20, 1988

[54] RUDDER FOR A WATER VESSEL

[76] Inventor: Donald C. Cruson, 3726 Dana Rd., Bellingham, Wash. 98225

[21] Appl. No.: 44,796

[22] Filed: Apr. 30, 1987

[51] Int. Cl.[4] ..... B63H 25/06

[52] U.S. Cl. ..... 114/163; 114/167

[58] Field of Search ..... 114/167, 163, 162; 440/43

[56] References Cited

U.S. PATENT DOCUMENTS

| | | | |
|---|---|---|---|
| 42,494 | 4/1864 | Lewis | 114/167 |
| 46,807 | 3/1865 | Le Pelly | 114/167 |
| 1,872,038 | 8/1932 | Hitzler | 114/163 |
| 2,910,954 | 11/1959 | Uecker | 114/167 |
| 2,972,323 | 2/1961 | Einarsson et al. | 114/162 |
| 3,009,435 | 11/1961 | Horton | 114/163 |

FOREIGN PATENT DOCUMENTS

| | | | |
|---|---|---|---|
| 165388 | 6/1964 | U.S.S.R. | 114/163 |

*Primary Examiner*—Joseph F. Peters, Jr.
*Assistant Examiner*—Thomas J. Brahan
*Attorney, Agent, or Firm*—Hughes, Cassidy & Multer

[57] ABSTRACT

A rudder assembly which includes a frame formed by upper and lower horizontal flanges which are connected to a rudder post. A pair of parallel vertical sidewalls are connected to the upper and lower flanges, and a main rudder blade is connected to the upper and lower flanges between, and parallel to, the sidewalls. A forward blade is pivotally connected to the frame at a location forward of the main blade for movement about a vertical axis between a non-turning position where the forward blade is generally aligned with the main blade, and a turning position where the rear edge of the forward blade engages one of the sidewalls to form a channel for feeding water along the backside of the main blade to improve rudder turning efficiency.

3 Claims, 4 Drawing Sheets

RUDDER FOR A WATER VESSEL

TECHNICAL FIELD

The present invention relates to a rudder for improving the turning capability of a water vessel.

BACKGROUND OF THE INVENTION

Historically, it has been useful to provide improved rudders which have the capability of turning a water vessel in a short distance. A highly satisfactory rudder is generally considered to be one which can turn a boat through 90° while traveling forward a distance of about $2\frac{1}{2}$ times the vessel's length..

It is known that when a maximum angle is exceeded by a rudder, burbling occurs along the rudder which results in a significant decline in rudder turning effectiveness. This burbling is defined as the separation and breakup of the streamline flow of water across the rudder, and consequent reduction in rudder lift. It is desirable, therefore, to eliminate, or at least delay, the onset cf rudder burble at higher rudder angles.

A number of conventional rudders have been disclosed. For example, in U.S. Pat. No. 4,515,101 by Akerblom there is disclosed a rudder having a lengthwise interior cavity which is divided into two smaller cavities to allow water to enter an upstream side of the rudder and through a hollow channel within the rudder and to exit the rudder through openings in a downstream side of the rudder.

Another rudder system disclosed by Easter in U.S. Pat. No. 2,996,031, utilizes a number of flanking rudders and steering rudders which include front and/or rear articulated portions for improving vessel maneuverability.

Another rudder system utilizing flanking rudders is disclosed in U.S. Pat. No. 3,181,492 by Hockett, in which there is provided a central vertical rudder flanked by left, right smaller vertical rudders which are joined to the central rudder by upper and lower horizontal fins. A further rudder system utilizing a flanking rudder is disclosed by Einarsson in U.S. Pat. No. 2,972,323, in which the rudder system has a central vertical rudder flanked by left, right vertical laminar members which are joined to the central rudder by transverse extending struts.

Other rudder systems include U.S. Pat. No. 132,991 to Thomas, which includes a pair of upstanding rudder sections connected between a pair of horizontal discs and supported above a second pair of lower upstanding rudder sections which are also connected between a second pair of horizontal discs.

U.S. Pat. No. 99,639 to Coleman pertains to a rudder system incorporating a vertical central rudder to which left, right vertical blade sections are attached to opposite sides of the central rudder in a parallel manner.

Additional rudder systems using flanking rudders have been disclosed by Horstman in U.S. Pat. No. 2,251,133, in which the flanking rudders are pivotally aligned in a parallel manner with the water slipstream in a non turning mode, and when turned in a 45° angle, the rudders are axially aligned with each other to form a single rudder.

Furthermore, in U.S. Pat. No. 2,328,041 to Wellons, there is a rudder system including a central rudder flanked by left, right curved vanes which are connected to the central rudder so that when the rudder is turned, the vanes exclude water from approaching the propeller from one side, and direct water toward the propeller from the opposite side, to aid in turning the boat.

Another rudder system which is disclosed by Uecker in U.S. Pat. No. 2,910,954, utilizes a main vertical rudder having a forward rudder section which pivots independently of the main rudder.

Also, in U.S. Pat. No. 2,686,490 by Bencal, there is disclosed a rudder system utilizing a pair of vertical rudders which are interconnected by upper and lower horizontal flanges and which include a horizontal fin mounted between the vertical rudders near their upper ends.

SUMMARY OF THE INVENTION

The present invention pertains to a rudder assembly for a water vessel. The rudder assembly includes a frame which is connected to the water vessel for selected movement in response to rudder actuating apparatus located in the vessel.

The rudder assembly further includes first and second upstanding sidewalls which are connected in a spaced apart, generally parallel manner between upper and lower portions of the frame. There is provided an upstanding central blade which is connected between the upper and lower frame portions at a location intermediate the first and second sidewalls. In addition, there is provided a forward swinging blade which is pivotally connected about an upstanding axis to the frame at a location forward of the central blade. The forward blade moves between (i) a first nonturning position in which the forward blade is generally aligned with the central blade, and (ii) a first turning position in which the forward blade pivots toward the first sidewall in response to movement of the frame means in a first pivotal direction so that the forward blade trailing edge is generally laterally aligned with, or is rearward of, the first sidewall forward edge. This forms a first water flow channel between the central blade, and a combination of the forward blade and the first sidewall, to inhibit burbling along the central blade.

In a second turning position, the forward blade pivots toward the second sidewall in response to movement of the frame means in a second pivotal direction so that the forward blade trailing edge is generally laterally aligned with, or is rearward of, the second sidewall rearward edge. This forms a second water flow channel between the central blade and a combination of the forward blade and the second sidewall.

It is an object of the present invention to provide a rudder which improves the turning capability of a water vessel.

BRIEF DESCRIPTION OF THE DRAWINGS

This and other objects and advantages of the present invention will become more readily apparent upon reading the following Detailed Description and upon reference to the attached Drawings, in which.

Figure 1:
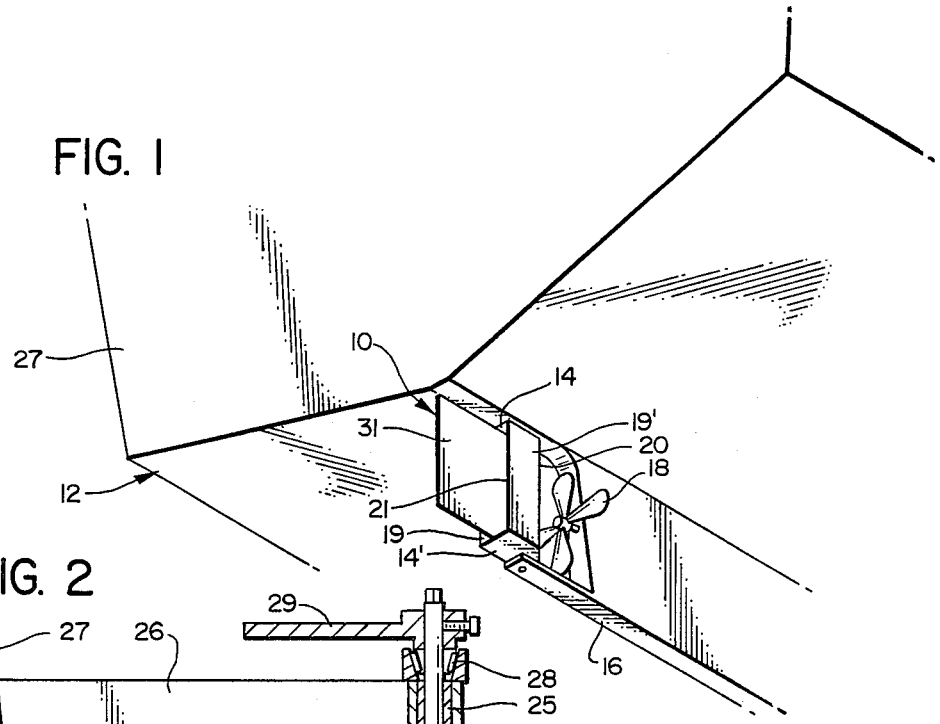
FIG. 1 is an isometric view of the rudder assembly attached between the upper hull and lower skeg of a boat.

While the present invention is susceptible to various modifications and alternative forms, specific embodiments thereof have been shown by way of example in the Drawings and will herein be described in detail. It should be understood, however, that it is not intended to limit the invention to the particular forms disclosed, but on the contrary, the intention is to cover all modifications, equivalents and alternatives falling within the spirit and scope of the invention.

DETAILED DESCRIPTION

Figure 2:
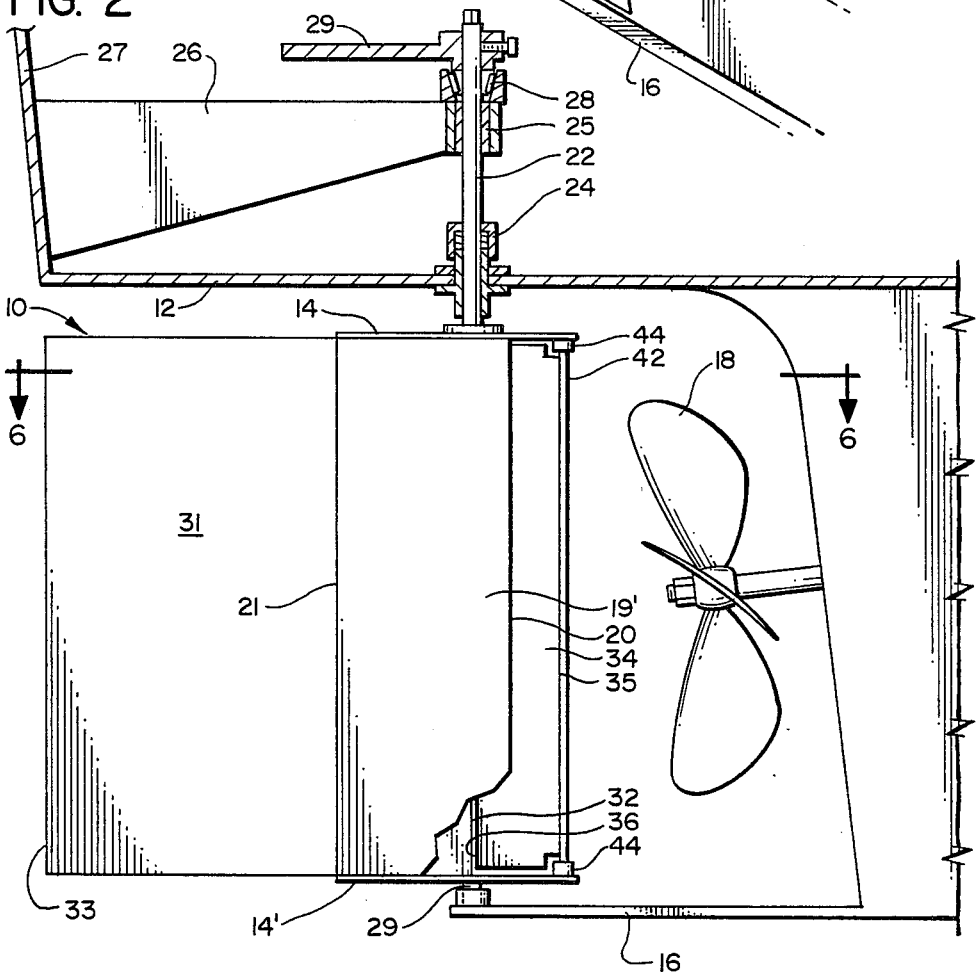
FIG. 2 is a side view of the rudder assembly of the present invention.

Referring to FIG. 1, the present invention pertains to a rudder system indicated at 10 which is attached to the bottom hull 12 of a vessel. As shown more clearly in FIGS. 1 and 2, the rudder includes upper and lower horizontal flanges 14, 14', respectively, which are mounted between the boat hull 12 and a rearwardly extending skeg 16 at a location slightly aft of a propeller 18.

More particularly, a box-like portion of the rudder is formed by a pair of spaced apart left, right vertical sidewalls 19, 19' (FIGS. 2 and 6) having forward vertical edges 20 and rear vertical edges 21, and which are mounted at their upper and lower ends to the upper and lower flanges 14, respectively. In order to mount the rudder assembly to the boat, an upper rudder post 22 is pivotally mounted at its upper end within a watertight stuffing box 24 which is connected through the hull 12. The lower end of the upper rudder post 22 is rigidly fastened to the upper surface of the upper flange 14.

To alleviate large forces exerted on the stuffing box, a secondary bearing 25 is installed about the rudder post 22 with the bearing being supported by a horizontal brace 26 which is connected to a rear transom 27 of the boat. Furthermore, the rudder is supported vertically by means of a thrust bearing 28 which is mounted between the brace 26 and a rudder quadrant 28. The rudder quadrant 28, in turn, is connected to rudder actuating apparatus (not shown) located inside the vessel.

The rudder is further supported by a lower rudder post 29 which is rigidly fastened to the lower surface of the lower flange 14'. The rudder post 29 is pivotally engaged within a gudgeon which is attached to the upper surface of the skeg 16. In an exemplary embodiment, the upper flange 14, the lower flange 14' and the sidewalls 19 have thin, rectangular planar configurations of approximately five eighths of an inch thickness.

The rudder 10 is further formed by a central or main vertical blade 31 having a vertical leading edge 32, a vertical trailing edge 33, and a rectangular planar configuration. The blade 31 is rigidly mounted at its upper and lower edges, respectively, to the upper and lower flanges 14, 14', respectively, in a manner equidistant between, and parallel to, sidewalls 19. The central blade 31 extends rearward beyond rear edges 21 of the sidewalls 19.

In order to direct the flow of water across the central blade 31, there is provided a forward free swinging vertical blade 34 (FIGS. 2 and 6) having a vertical leading edge 35, a vertical trailing edge 36, and rectangular planar side surfaces. The forward blade 34 is mounted on a vertical post 42 which is attached to the upper and lower flanges 14 at locations forward of the main rudder posts 22, 29 and in lengthwise alignment with the central blade 31. Blade 34 includes an upper horizontal edge which is located proximate to the upper flange 14 and a lower horizontal edge which is proximate to the lower flange 14'. To permit pivotal movement of the forward blade 34 about an imaginary vertical axis which is co-linear with the post 42, gudgeons 44 (FIG. 2) are mounted to the lower surface of the upper flange 14 and upper surface of the lower flange 14', to pivotally engage the rudder post 42 therein.

Having described the principal elements of the present invention, attention now will be turned to the operation of these elements in achieving improved rudder efficiency. However, prior to this, a brief background of conventional rudder operation will be provided.

Figure 3:
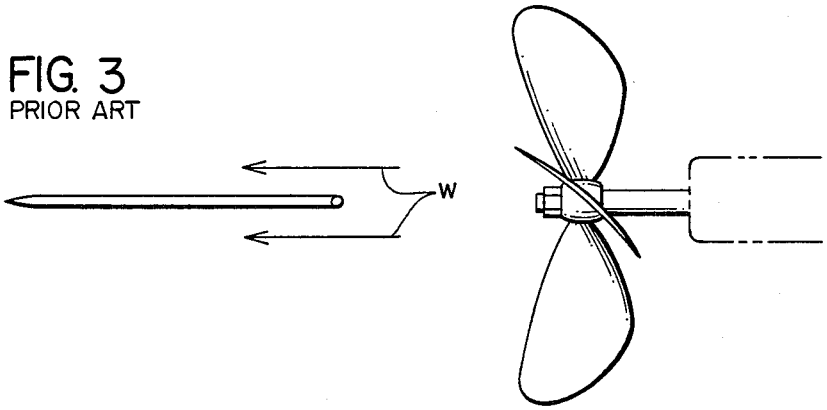
FIG. 3 PRIOR ART
FIG. 3 is a top view showing water flow past a conventional rudder which is centered amidships.

As shown in FIG. 3, when a conventional rudder is centered, i.e. the rudder is aligned with a lengthwise axis of the vessel, the direction of water flow, indicated by the arrows designated by the letter "w", is parallel to the vessel lengthwise axis. In this instance, the water pressure across the rudder is equal on both sides of the rudder and the vessel maintains a straight course. Typically, this water pressure is supplied by movement of the vessel through the water, as well as the water which is directed aftward by the mechanical action of the propeller (propwash).

Figure 4:
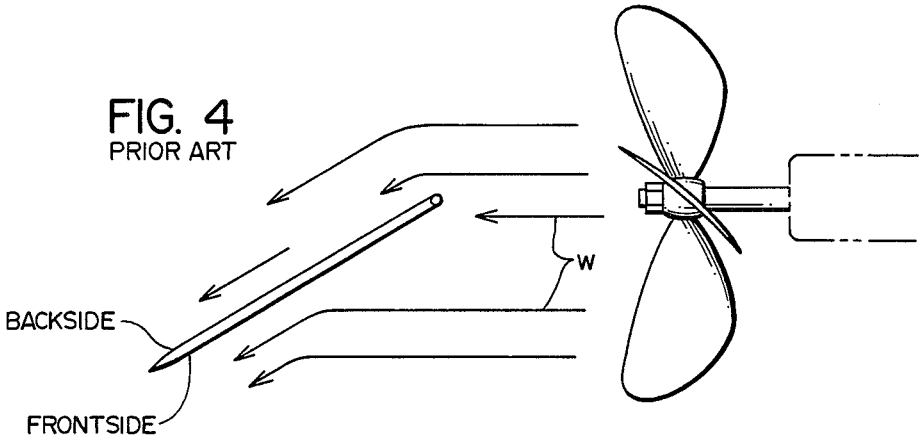
FIG. 4 PRIOR ART
FIG. 4 is a view similar to FIG. 3 except that the rudder is swung to starboard.

When the rudder is moved from its centered position, such as when swung to starboard as shown in FIG. 4, water flow occurs along the frontside, i.e. the surface of the rudder closest to the vessel's bow, and the backside of the rudder. However, in this rudder position there is a water pressure differential between the frontside and the backside of the rudder. The greater pressure on the frontside of the rudder causes the stern to move laterally, thereby turning the vessel's bow in the direction of the rudder swing.

Figure 5:
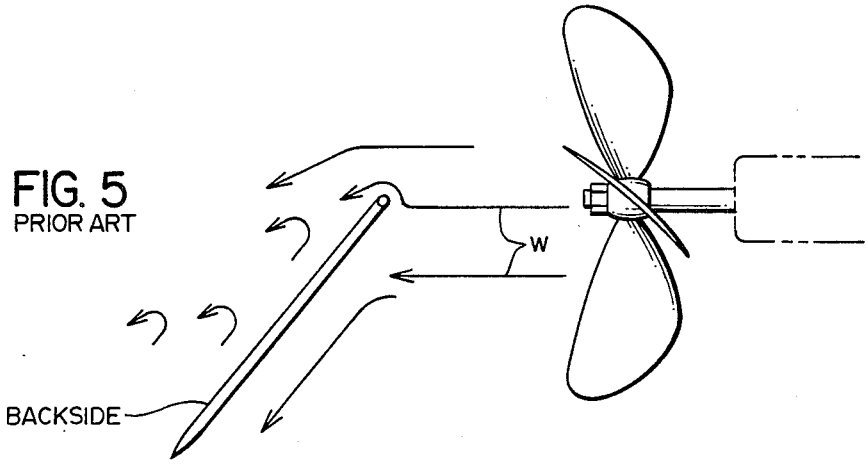
FIG. 5 PRIOR ART
FIG. 5 is a view similar to that of FIG. 4 except that the rudder is swung further to starboard causing burbling of the water flow along the rudder.

As mentioned in the Background of the Invention, as the turning angle of the conventional rudder increases, burbling can result along the backside of the rudder. As shown in FIG. 5, this burbling occurs due to the high rudder angle when the water can no longer flow smoothly along the backside of the rudder. It is believed that burbling is particularly severe in connection with rudders which have flat side surfaces.

Figure 6:
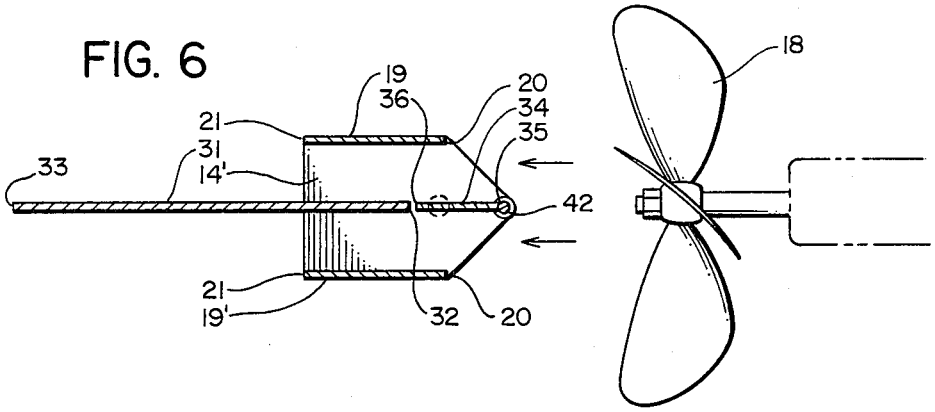
FIG. 6 is a top sectional view taken along line 3—3 of FIG. 2 in which the rudder of the present invention is aligned with a lengthwise axis of the vessel.

In order to overcome the aforementioned burbling problems in association with the swinging of the rudder, and particularly with regard to swinging a flat sided rudder, the rudder assembly 10 of the present invention is provided. As shown in FIG. 6, when the rudder is in the centered position, the rear edge 36 of the forward free swinging blade 34 is adjacent to the forward edge 32 of the main blade 31; a sufficient distance between edges 32, 36 being provided to allow the forward blade 34 to swing back and forth past the forward edge of the main blade 31.

Figure 7:
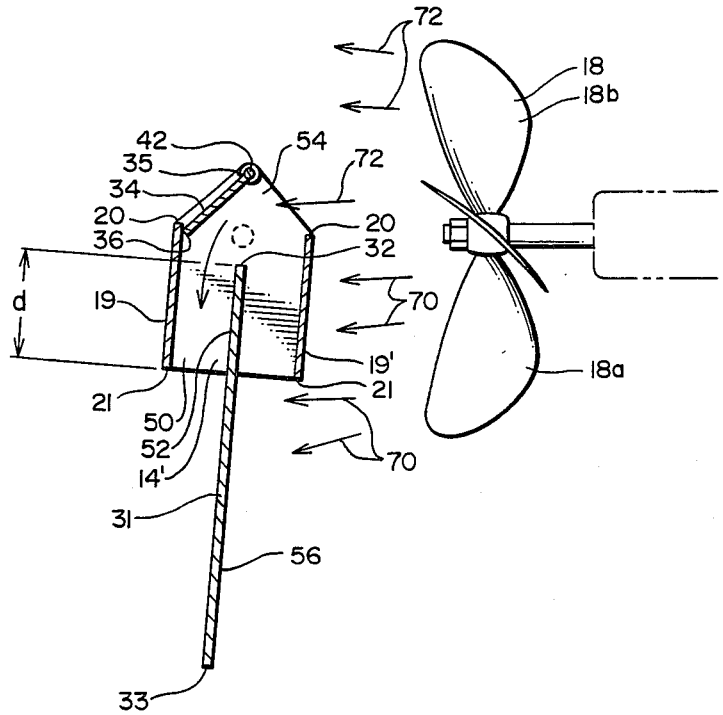
FIG. 7 is a view similar to that of FIG. 6 showing the rudder swung almost 90° to the lengthwise axis of the vessel.

However, when the rudder assembly is swung to starboard, for example, as shown in FIG. 7, the forward blade 34 is caused by the rearward flowing water to swing to port so that the rear edge 36 of the forward blade engages the inner surface of the port diversion sidewall 19. More particularly, port, starboard diversion sidewalls 19, 19', are sized so that the rearward edge 36 of the forward blade engages the sidewall 19 at a location slightly rearward of the forward edge 20. In this manner, a channel 50 is formed between (i) the forward surface of the freeswinging blade 34 in combination with the port diversion wall 19, and (ii) the backside surface 52 of the main blade 31. The channel 50 diverts the water along the backside of the main blade 31 to alleviate the burbling which occurs in conventional rudders. The water enters the channel 50 through an opening 54 formed by the forward edge 20 of the starboard diversion sidewall 19' and the rudder post 42 of the free swinging blade 40.

More particularly, instead of allowing the water to be disrupted along the backside of the rudder, it is believed that the diversion sidewall 19 causes an increase in water velocity through the channel 50 which is a function of a transverse distance between the sidewall 19 and central blade 31. The diversion sidewalls 19 have a sufficient lengthwise dimension to direct the flow of water along the backside of the blade at increased velocity. The increased water velocity minimizes separation and turbulence of the water flowing along the rudder backside. This permits the rudder assembly to be swung at angles up to about 85° relative to the lengthwise axis of the vessel, while still maintaining water flow along the backside of the central blade 31 to achieve a rapid turn. This is particularly noticeable at slow forward speeds where the vessel essentially pivots about its vertical axis.

In a preferred embodiment, the inner surfaces of the diversion sidewalls 19 are about four inches from the side surfaces of the main blade 31. This short distance between the diversion sidewalls and the central blade aids in retaining water flow along the backside of the blade. Utilizing a central blade having a length of about 20 inches as measured between the forward edge 32 and the rear edge 33, the length of the forward blade as measured between the leading edge 35 and the trailing edge 36 is at least about twenty percent of the length of the central blade 31. The height of the forward blade and main blade are about equal. The diversion sidewalls each have a length of about ten inches as measured between the forward edges 20 and the rear edges 21, and a thickness approximately equal to the thickness of the central blade so as to prevent bowing of the diversion sidewalls at high rudder angles. The rudder assembly is constructed so that approximately ten percent of the lengthwise dimension of the sidewalls 19 extend forward of the central blade leading edge 32, and the remaining ninety percent of the lengthwise dimension of sidewalls 19 form the walls for the channel 50. This dimension indicated by the letter "d" in FIG. 7, is at least about forty percent of the lengthwise dimension of the central blade 31. These dimensions permit the free swinging blade 34 is allowed to swing through an angle of about 45° before contacting the diversion sidewall.

To achieve optimum turning efficiency, the rudder assembly 10 is positioned so that when the rudder assembly is swung to about 85°, the forward edges 20 of the diversion sidewalls 19 are aligned with the shaft of the propeller 18. In this manner, a maximum flow of water is delivered from the propeller 18 through the opening 54 and into the channel 50 and along the backside of the central blade 31.

When in a starboard turn, for example, as further shown in FIG. 7, a large proportion of the water from a starboard blade **18*a* of the propeller is directed, as shown by the arrows designated by the numbers 70, against the frontside of the starboard diversion wall 20' and the frontside 56 of the central blade 30, thereby generating a rearward force on the rudder assembly. At the same time, the water directed from the port propeller blade 18*b* as shown by the arrows designated by the numbers 72, is directed rearward in front of the forward edge 35** of the rudder assembly. This has the combined effect of aiding the boat in turning to starboard.

What is claimed is:

1. A rudder assembly, responsive to rudder turning apparatus, for a water vessel having a forward end and a rearward end, said rudder assembly defining a flow area having an upper boundary, a lower boundary, and two side boundary areas, the rudder assembly comprising:

a. frame means which are operatively connected to the water vessel for selected movement, in response to the rudder turning apparatus, in first and second pivotal directions about a generally upstanding axis;

b. first and second upstanding side walls which are located at said side boundary areas and are connected in a spaced apart manner to the frame means, the first and second side walls each having a forward edge and a rearward edge and extending vertically substantially from said lower boundary area to said upper boundary area;

c. an upstanding central blade, including a forward edge and rearward edge, which is connected to the frame means and positioned intermediate the first and second side walls, said blade extending substantially from the lower boundary area to the upper boundary area;

d. a forward swinging blade, including a leading edge and a trailing edge, said forward blade being pivotally connected adjacent to the leading edge of the swinging blade about an upstanding axis to the frame means at a location forward of the central blade, for movement between (i) a first nonturning position in which the forward blade is generally aligned with the central blade, (ii) a first turning position in which the trailing edge of the forward blade pivots toward the first side wall in response to the selected movement of the frame means in the first pivotal direction so that the forward blade trailing edge is generally adjacent to the first side wall forward edge so as to form a first water flow channel between the central blade, and a combination of the forward blade and the first side wall, and (iii) a second turning position in which the trailing edge of the forward blade pivots toward the second side wall in response to a selected movement of the frame means in the second pivotal direction so that the forward blade trailing edge is generally adjacent to the second side wall forward edge so as to form a second water flow channel between the central blade and a combination of the forward blade and the second side wall;

e. said assembly being characterized in that:

(i) the forward edges of the two side walls are positioned forwardly of the forward edge of the central blade, and the trailing edge of the forward blade is adjacent to and forward of the forward edge of the central blade when the forward blade is in the first non-turning position, (ii) the leading edge of the swinging blade is located forward of the forward edges of the side wall;

(iii) the rearward edge of the central blade is positioned a substantial distance rearwardly of the rearward edges of the side walls in a manner that the central blade has functionally a forward channel defining central blade portion located between the two side walls and a rear extension portion.

2. The rudder assembly as set forth in claim 1 wherein the first and second sidewalls are spaced apart from the central blade in a generally parallel manner (i) to increase a velocity of water flow through the first water flow channel when in the first turning position, and (ii) to increase a velocity of water flow through the second water flow channel when in the second turning position.

3. The rudder assembly as set forth in claim 1 wherein:

a. said frame means comprises an upper frame portion which includes a generally horizontal upper flange which is connected between the first and second side walls, and a lower frame portion which includes a generally horizontal lower flange which is connected between the first and second side walls;

b. the frame means includes vertical post means which are connected to the upper and lower flanges; and c. the vertical post means are operatively connected to the rudder turning apparatus.

* * * * *